United States Patent [19]

Foederer

[11] 4,391,484

[45] Jul. 5, 1983

[54] BOX CONNECTOR

[75] Inventor: Wilhelmus T. M. Foederer, Best, Netherlands

[73] Assignee: E. I. Du Pont de Nemours and Company, Wilmington, Del.

[21] Appl. No.: 252,881

[22] Filed: Apr. 10, 1981

[30] Foreign Application Priority Data

Jun. 26, 1980 [NL] Netherlands ..... 8003708

[51] Int. Cl.[3] ..... H01R 13/38

[52] U.S. Cl. ..... 339/97 P

[58] Field of Search ..... 339/97, 98, 99

[56] References Cited

U.S. PATENT DOCUMENTS

| | | | |
|---|---|---|---|
| 2,475,448 | 7/1949 | Cusato | 173/324 |
| 3,147,058 | 9/1964 | Zdanis | 339/97 R |
| 3,611,263 | 10/1971 | Krone et al. | 339/97 |
| 3,636,500 | 1/1972 | Sedlacek | 339/97 R |
| 3,910,671 | 10/1975 | Townsend | 339/97 R |
| 4,171,858 | 10/1979 | Knowles et al. | 339/99 R |
| 4,186,984 | 2/1980 | Reavis, Jr. et al. | 339/103 |
| 4,261,629 | 4/1981 | Reynolds et al. | 339/98 X |

FOREIGN PATENT DOCUMENTS

| | | |
|---|---|---|
| 5350 | 2/1980 | European Pat. Off. . |
| 2131769 | 12/1972 | Fed. Rep. of Germany . |
| 2210843 | 12/1974 | France . |
| 2378390 | 1/1977 | France . |
| 493112 | 6/1970 | Switzerland . |

*Primary Examiner*—Joseph H. McGlynn
*Assistant Examiner*—Timothy V. Eley

[57] ABSTRACT

A box connector in which each side wall contains a slot having an insulation piercing contact. One pair of slots in opposite walls are on a different level from a second pair of slots for accommodating two different conductor wires.

6 Claims, 16 Drawing Figures

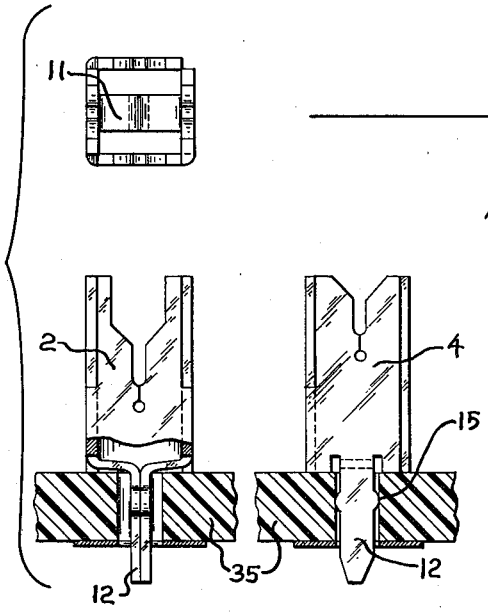
Fig. 9
Fig. 10
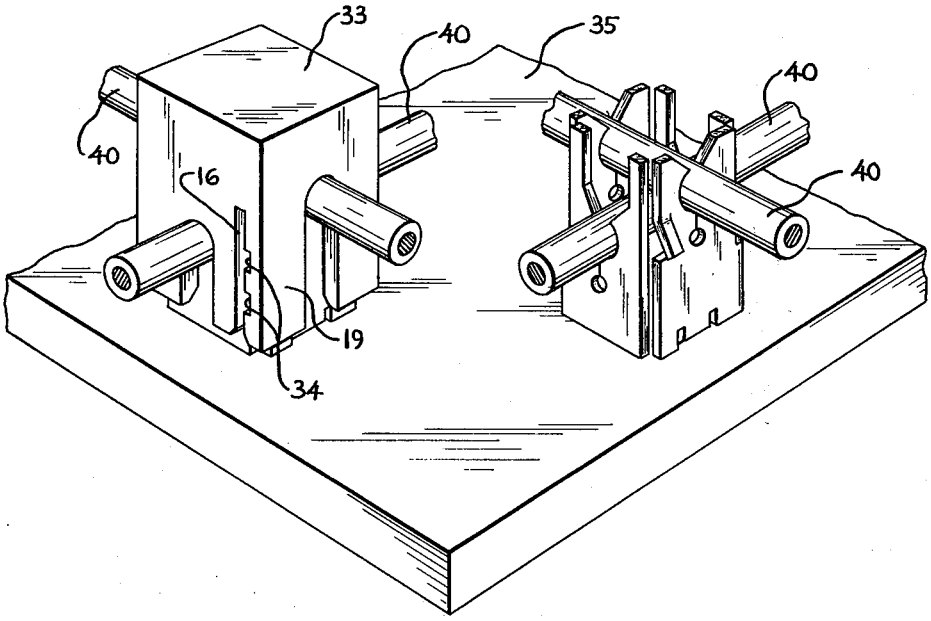

BOX CONNECTOR

BACKGROUND OF THE INVENTION

The invention relates to a connector with insulation piercing contacts. In particular, it refers to connecting several conductors on a printed circuit board by means of a box connector.

Known connectors for connection wires are generally soldered, but have the disadvantage that individual connection wires cannot be readily and quickly connected or be replaced with repairs, especially when several conductors must be connected or are connected to one connection pad of the board.

SUMMARY OF THE INVENTION

This disadvantage is avoided by the box connector according to the present invention which is characterized by a box made of electrically conductive sheet material, with slots for insulation piercing contacts arranged in the vertical side walls; these slots extend from the top of the box over a predetermined length towards the bottom of the box. Connecting strips are formed at the lower edge on opposite side walls, which initially converge and subsequently extend downward and adjacent to each other.

The words "top" and "bottom" indicate in the above and in the following description those box portions which after mounting the box on the printed circuit board are positioned farthest away and nearest the board, respectively.

The slots of the insulation piercing contacts preferably terminate at different levels, as seen in the downward direction of the box. Corresponding pairs of slots are each arranged in opposite side walls in such a way that two slots of each pair terminate at a different level with respect to the bottom of the box compared with the slots of another pair or other pairs in the box.

The horizontal cross section through the vertical side walls may be a circle, an ellipse, a polygon, a rectangle, or a square. A square is preferred.

As a result of the different slot depths of each pair, several connection wires can make contact with the box connector; these wires are pushed from above into the slots and stacked. A large number of connection wires can be connected with each box connector. In general, the wires will be passed through the box connector so that two wires crossing each other can be stacked.

When inserting the connection wires in the slot, the sharp slot edges first cut the insulation jacket, the sharp slot edges digging into the conductive cores. A very good and reliable electrical contact can be made very quickly in this way.

The box connectors according to the invention are generally positioned with the downward extending connecting strips inserted into connection openings of printed circuit boards. It is then soldered into place.

The connection strips are formed at the bottom of the box in two opposing side walls, entailing:

(a) bending the material through the first angle and away from the plane of the box, approaching each other to form a neck;

(b) subsequently, at the end of the neck, the material is rebent downwards through a second angle whereby the strips are parallel to the box sides;

(c) finally, these strips extend downwards, and in doing so, touch each other over their remaining length.

The area of initial bend angle in the strip, and hence at least the commencement of the neck, is located slightly above the lowest edge of the box. The side walls of the box have recesses at their point of transition with the connection strips. The above arrangements are such that when the wires are being inserted into the slots, the lowest edge of the box bears on the printed circuit board surface. In doing so, the stress transmitted to the corresponding solder joint can be limited.

Prior to subjecting the printed circuit board to the soldering operation, the box connectors is preassembled by locating the connection strips in the appropriate hole or openings in the printed circuit board. Additionally, these connection strips will preferably have equally formed protrusions or cams for proper press fitting into these board openings, thus preventing the box connector from falling out prior to, or during soldering operations.

The box connector according to the invention preferably will be used with a plastic housing with inside dimensions corresponding to the outside dimensions of the box connector so that the housing can be placed on the box connector from above. The side walls of this plastic housing have slots which extend from the lower edge of the housing for a predetermined distance towards the upper edge. When the plastic housing is placed on the box connector, these slots coincide with the slots of the insulation piercing contact thereby leaving them exposed. The width of the slots in the plastic housing is preferably equal to the cross section of a connection wire with insulation jacket to be inserted in the box connector. These slots are also preferably semicircular in shape at their upper end so that a force can be exerted with a good contact surface on the connection wires when they are inserted into the box connector by means of this housing. Since the slots in the box connector terminate at different levels so that the wires can be stacked, the appropriate slots in the plastic housing must also terminate at different levels.

The plastic housing is also used as a means for holding the connection wires in place. The box connector can be provided for this purpose in at least one side wall with a strip for locking the plastic housing to be placed on the box connector. This strip preferably consists of an outwardly bent strip-shaped portion and an appropriate recess is arranged in the inside wall of the housing in which the strip is received after the housing has been placed on the box connector. As a result, the housing is safeguarded against unintentional removal from the box connector and the connection wires are also held in place.

Flat cables or ribbon cables can also be connected by means of the box connector according to the present invention. For this purpose, the individual wires of these flat cables must be separated in advance from each other.

DESCRIPTION OF THE DRAWINGS

The invention will be further explained by means of the drawings which show exemplified embodiments.

FIG. 9 shows a top view and two corresponding side views of a box connector of the present invention;

FIG. 10 shows in perspective view a part of a printed circuit board, mounted thereupon two box connectors of the present invention, each of which having connected therewith connection wires;

DETAILED DESCRIPTION OF THE INVENTION

Figure 1:
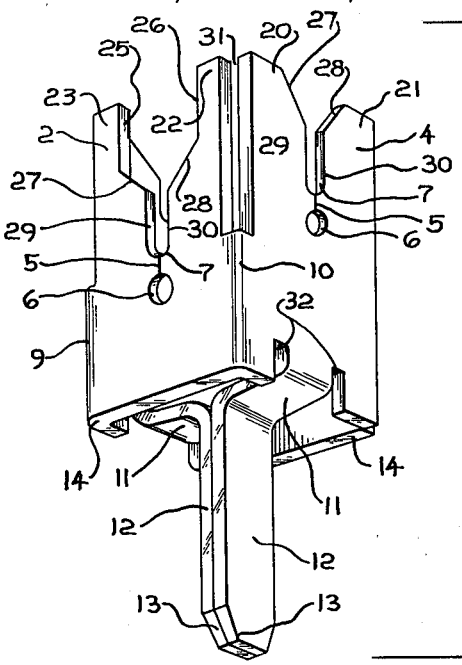
FIG. 1 shows on an enlarged scale in perspective view a solderable box connector of the present invention.
Figure 2:
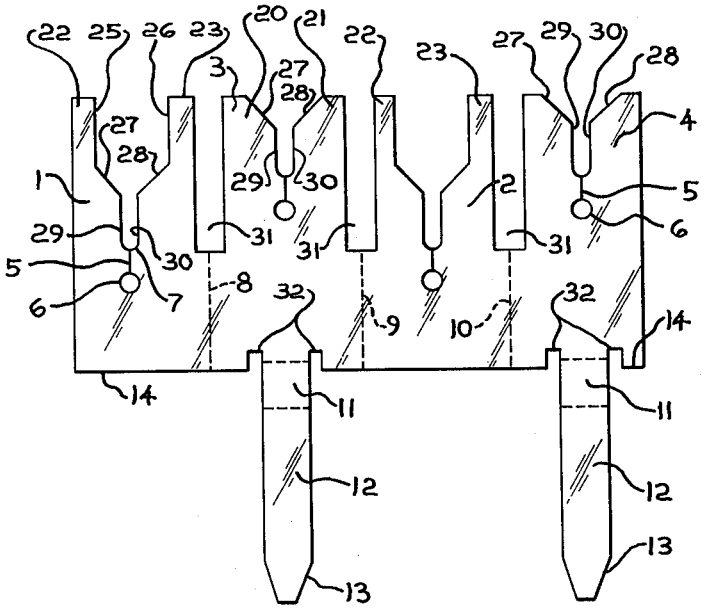
FIG. 2 shows the punched out flat, electrically conducting blank of resilient sheet material prior to bending.

The box connector according to the invention shown in FIG. 1 is preferably made from electrically conductive, resilient sheet material whereby first, for example, the blank of FIG. 2 is obtained by punching out. This is then folded according to the interrupted lines 8, 9 and 10 each time by 90° so that the rectangular box of FIG. 1 is produced.

The flat blank of FIG. 2 and, therefore, also the box connector of FIG. 1 is provided with four insulation piercing contacts, respectively, designated with 1, 2, 3 and 4 whereby the insulation piercing contacts 1 and 2 form a first pair of contacts and the insulation piercing contacts 3 and 4 form the second pair (located opposite from each other in FIG. 1). Each contact consists of a pair of raised beams 20, 21 and 22, 23, respectively (FIGS. 1 and 2 only show two by reference number). Two adjacent seams together constitute a single insulation piercing contact.

FIGS. 1 and 2 show two differently designed insulation piercing contacts which differ in the depth of the slot. The deep slots in contacts 1 and 2 have two edges 25, 26 at a distance from each other, then two tapered edges 27, 28 and finally two adjacent edges 29, 30 which form the actual insulation piercing contact.

The edges 29 and 30 of the slots have sharp edges so that they dig into a conductive core when the core is pressed down between the edges 29 and 30. Each slot is defined on the bottom by a semi-circular edge 7 which finally halts the core after it is pressed down.

A cut 5 which extends downward into a circular hole 6 exits in the slot at the semi-circular edge 7. This cut 5 and hole 6 have the advantage that the two beams 22, 23 and 20, 21, respectively, can easier separate when the core is inserted and are not so readily skewed in relation to each other in cross direction. The cut or gap 5 and the hole 6 enlarge the spring path of the insulation piercing contact in the planes of beams 20, 21 and 22, 23, respectively.

Between adjacent insulation piercing contacts at the bent portions of the box, slots 31 are provided which permit the spring action of each insulation piercing contact. These slots 31 can have a larger or smaller width than shown in the figures, but are also not essential to the novelty. After bending the flat blank of FIG. 2 to form the box per FIG. 1, and also in case when slots 31 are absent, adequate spring action can be obtained within the plane of beams 20, 21 and 22, 23, respectively.

The essential functional difference between the insulation piercing contacts formed by beams 20, 21 and 22, 23, as stated above, is the difference in levels of the lower half circular edges 7 of the slots. Hence the connection wires can be stacked above each other in the box connector in a manner to be discussed later.

At the lower ends of each box connector two strips 12 are formed during punching of the blank. Subsequently, these strips are bent as shown in FIG. 1, prior to or after bending the blank to obtain the rectangular box shown in FIG. 1. First these strips 12 are initially bent 90° towards each other. After they have approached each other sufficiently, they are rebent through 90° such that the strips 12 touch each other. Between the two 90° bends in each strip is located a neck portion 11. FIG. 1 shows that the bends and neck portion 11 are located above the lower edge 14 of the box connector. In order to obtain this higher location of the neck, recesses 32 have to be located where the strips are connected to the box side walls.

The flat blank of FIG. 2 will be bent as discussed above through 90° until the outer left edge approaches the outer right edge of this flat blank, as shown in FIG. 1, right-hand side. These adjoining edges may be left unconnected whereby a slot is formed, but also can be soldered, if necessary for certain applications.

By means of connector strips 12 the box connector of the present invention can be connected to a connection opening of the printed circuit board. The strips 12 comprise lead-in 13 with beveled edges, facilitating the entry of the connection strips 12 into the opening of the printed circuit board.

Figure 3:
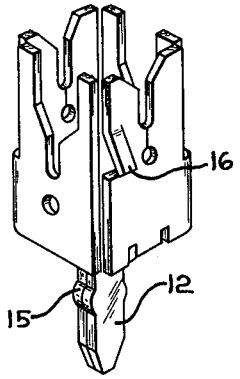
FIG. 3 shows a perspective view of the box connector of the present invention, in a direction different to that in FIG. 1 to show additional members.

FIG. 3 shows in perspective view a box connector of the present invention in which the connection strips 12 have integrally formed broadened portions or cams 15. These cams provide a press-fit in the printed circuit board hole, so that the box connector can be rigidly fixed in this hole prior to soldering of connection strips to the electrical connection portions or pads of the printed circuit board. Simultaneously, these cams 15 are useful in locking and holding the connector during the actual soldering operation.

Figure 6:
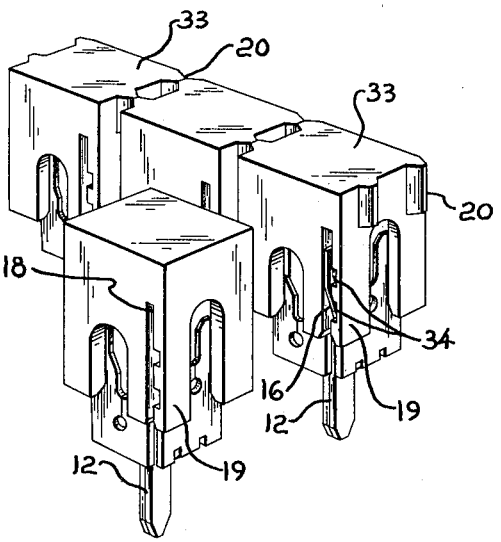
FIG. 6 shows several box connectors of the present invention, each with a preassembled plastic housing.

The box connector of FIG. 3 further comprises an outwardly bent strip or catch 16 located at the continuous slot between adjoining side walls of the box connector, corresponding to the right-hand and the left-hand edges of the blank in FIG. 2. The strip 16 locks the box connector to the plastic housing 33. This locking can be undertaken in two positions. In the first position the connection wires can be introduced sideways into the connector. The second locking position is when the wires have been inserted in their respective slots. Variants of the plastic housing 33 are shown in FIGS. 4, 5 and 6.

Figure 4:
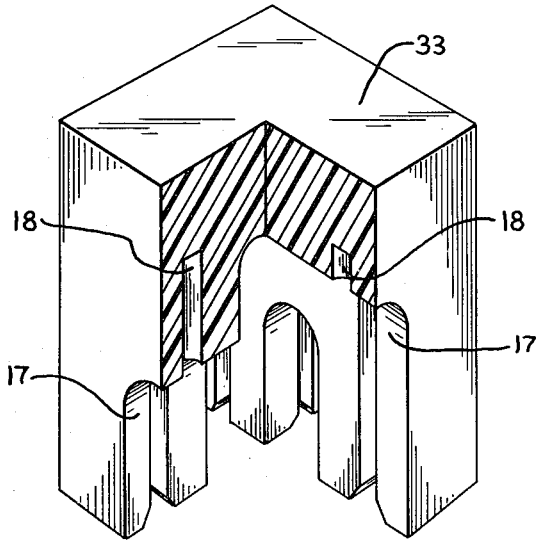
FIG. 4 shows the plastic housing for the box connector of the present invention, with a portion of the housing cut away.
Figure 5:
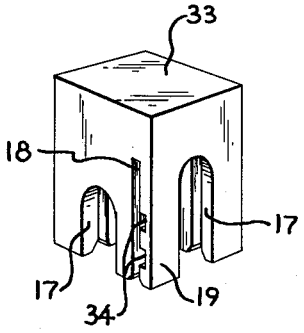
FIG. 5 shows the plastic housing in perspective view.

FIG. 4 shows the typical functional details of the housing 33 in perspective view, whereby one corner is cut away. The housing 33 consists of a rectangular box closed at the upper end. The four raised side walls have transverse openings 17. These openings line up with the slots of the insulation piercing contacts in the box connector. In doing so, the sharp edges of the box connector slots are free and accessible when the housing 33 is mounted over the box connector.

In the embodiment of FIG. 4 each side wall further comprises a groove or slot 18. Provisions are made that they completely accept the beams 20, 21 and 22, 23, respectively, of each insulation piercing contact when the housing is fully pushed down over the box connector. This entails that the beams are adequately supported on each side surface. Hence, during insertion of connection wires in the slots of the insulation piercing contact achieved by pushing down on the housing 33, the connector beams will not skew.

Specific design features of the plastic housing 33 incorporate also a strain relief for the connection wires during actual use. This strain relief function is affected when the strip 16 of the box connector shown in FIG. 6, engages in one of the recesses 34 in the inner wall of housing 33. The slot or groove 18 here extends through the adjoining outer housing wall. As shown on the left-hand side of FIG. 6, the slot is shown to merge with the outer surface of the adjoining wall. The resilient side strip 19 of the housing 33 formed at one side of the groove or slot 18, and extending towards the outer surface, has at its inner surfaces recesses 34. When the housing 33 is placed over the box connector, the outwardly bent strip 16 of the box connector will engage and latch with one of these recesses 34. When the housing 33 is in the fully locked position, it cannot be pulled off from the box connector by disturbing forces. Examples of the latter are force acting on the connection wires which have a force component directed in the upward direction.

In FIGS. 5 and 6 two recesses 34 are shown. The lowermost recess is used to hold the plastic housing in a preloaded position on the box connector. This is of advantage, because now the housing and box connector are firmly united which facilitates shipment or during certain steps in manufacturing. After positioning such box connector together with preloaded plastic housing on a printed circuit board, the soldering can be undertaken. Subsequently, the connection wires can be introduced through the groove in the plastic housing above the insulation piercing contacts. Thereafter, the plastic housing can be pushed downward for insertion of the connection wires in the slots of the insulation piercing contact. Thereafter, the strip 16 will be latched in the upper recess 34.

Also at the other side or edge of the housing 33, a groove 18 can be provided which will cooperate with a second outwardly bent strip 16.

FIG. 6 shows a number of adjoining plastic housings. Each housing consists of integrally formed triangular notches 20. In general several housings 33 will be molded simultaneously, whereby these separate housings 33 are connected to one another by means of these triangular notches 20. Since these notches connect several housings, one row of box connectors can be mounted simultaneously on a printed circuit board. The mutual distance between these box connectors will be equal to the center distance of the circular connection holes in the printed circuit board. Also, this mutual connection, by means of notches 20, produces a much stronger total assembly to withstand higher forces introduced by possible pulling of the connection wires. When required these housings may be separated from each other by breaking off at the notches 20.

Figure 8:
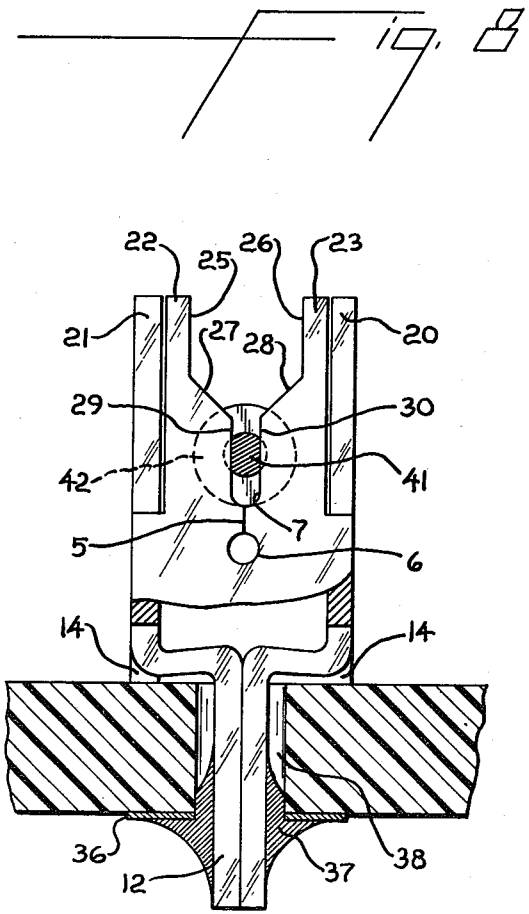
FIG. 8 shows the same view as FIG. 7, during the insertion of a connection wire.
Figure 7:
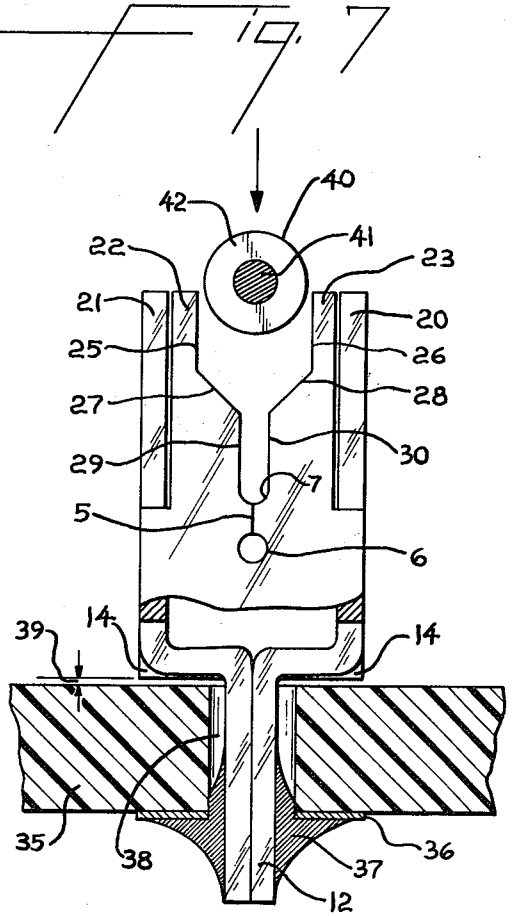
FIG. 7 shows on an enlarged scale partly in cross section the box connector of the present invention mounted on a printed circuit board, prior to the insertion of a connection wire.

FIGS. 7 and 8 show the side view of such box connectors according to the present invention, partly in cross section, during insertion of a connection wire. The wire termination and connection process can be subdivided into three individual steps. First the box connector, for instance carrying the plastic housing in preloaded position with strip 16 in the first or lower recess 34, is mounted on the printed circuit board and if necessary soldered. Next, the connection wires are located over the slots of the insulation piercing contacts by passing them through the openings of the transverse grooves in the plastic housing above the insulation piercing contacts. Alternatively, a plastic housing can be placed over each box connector with connection wires in place. Finally, the housing is pressed downward such that the strip 16 is received in the second or upper recess 34 in the resilient strip 19, and wire connection is completed.

In FIGS. 7 and 8 the box connectors are soldered on the printed circuit board 35 comprising the wiring 36. In these figures, only the connection pads are visible. The connection strips 12 of the box connectors are inserted in the hole 38 of printed circuit board 35. The lower edge 14 of the connector box bears the upper surface of the printed circuit board 35. By means of the cams 15 in FIG. 3, which are not shown in FIGS. 7 and 8, the box connector will be locked and held temporarily on the printed circuit board. These cams 15 are slightly broader than the diameter of the hole 38. Finally, the connection strips or tail 12 are soldered to the connection pad or connection ring of the wiring portion of the printed circuit board by means of solder 37.

By pressing the connection strips or tail 12 into the hole 38, but also after the soldering operation, some clearance 39 may exist between the lower edge 14 of the box connector and the upper surface of the printed circuit board. When a connection wire 40, comprised of a core 41 and insulation 42 is pressed from above between the edges 29 and 30 of the insulation piercing contact, a relatively large mechanical stress is transmitted to the solder joint, particularly to the connection pad 36 of the printed circuit. This can be a disadvantage since the adherence of the pad 36 to the circuit board 35 can be affected which may be detrimental to the electrical performance of the printed circuit. Additionally in these cases, the electrical resistance of the soldered joint may also be adversely affected. Towards reduction of these undesirable affects, the connection strips 12 are bent towards one another through the neck portion 11 to form an intermediate resilient portion. When the box connector is pressed downwards, the lower edge 14 rests upon the upper surface of printed circuit board 35 due to the compliance of the neck portion 11. As such, the pressure now will be accepted mainly by the printed circuit board 35, and to a much less extent by the soldering junction 37 and the printed connection pad 36. It must be kept in mind that mechanical stress generated in the connection pad 36 or in the solder junction can have a detrimental effect on electrical performance of the printed circuit.

When the wire 40 is pressed downward into the box connector, the outer surface of the insulation 42 is pressed between the edges 25 and 26 at the upper side of the insulation piercing contact. Next, the insulation 42 engages with the sharp edges 27 and 28 such that the insulation is cut. Further downward movement of wire as shown in FIG. 8 results in that core 41 is pressed between the sharp edges 29 and 30. Simultaneously these edges dig into the material of core 41. The lowest position of the wire 40 is determined when the insulation 42 rests on and is limited by the rounded lower portion 7. Under these conditions, the end position of the core in the insulation piercing contact has been reached. The serration 5 and slot hole 6 together constitute a pivot point for the edges 29 and 30, which is effectively displaced at a lower level with respect to the rounded portion 7. In effect, the spring action or elasticity of the insulation piercing contact is increased.

The plastic housing 33 is not essential for the box connector of the present invention. However, the housing does facilitate insertion of the connection wires 40 in the insulation piercing contacts and also functions as a strain relief. Simultaneously the neatness and appearance of the printed circuit board assembly is enhanced.

FIG. 9 shows a top view and two side views respectively of a box connector of the present invention mounted on the printed circuit board 35, without the plastic housing. FIG. 9 shows also how the cam 15 is clamped within the hole of the printed circuit board 35 to hold the box connector in its place. The side elevations show further, the different levels of the insulation piercing contacts 1, 2 and 3, 4, respectively, of the raised opposite side walls.

FIG. 10 shows two box connectors of the present invention in perspective view, mounted on a board 35 having at the lower side a printed circuit (not shown). The right-hand side in FIG. 10 shows two connection wires 40 inserted in the box connector such that said wires rest in the rounded lower ends of each slot of the corresponding insulation piercing contacts. At the left-hand side in FIG. 10, the housing 33 is positioned over the box connector in its lowest position. The strip 16 is located now in the uppermost or second recess 34 of the resilient strip 19.

The connection wires 40 can be inserted into each insulation piercing contact by means of a particular tool. Alternatively, these wires can also be positioned according to the right-hand portion of FIG. 10 within the broader slot portions of each insulation piercing contact; subsequently these conductors are pressed down by the housing 33 between the approaching beveled edges and into the narrow slot defined by the opposite edges of the insulation piercing contact. Finally, the above steps lead to the establishment of an electrical contact between the edges 29 and 30 of the slots. It is to be noted that when the plastic housing is pressed down from its initial preloaded position, the outwardly bent strip 16 is received in the upper recess 34. Hence the housing 33 is locked over the insulation piercing contacts, and in doing so the connection wires 40 are held down in their final position.

FIG. 10 shows two box connectors of the present invention, each having two connection wires terminated in the crossed fashion. In fact, this embodiment of the invention also permits four individual wires to be connected with the box connector. In this case, one wire end is connected in each of the four insulation piercing contacts. Of course, in a polygonal box connector having more than four sides, a larger number of conductors can be terminated. The novel design also permits that these conductors can be stacked over each other and have the freedom of inserting individual connection wires in individual insulation displacement contacts.

Figure 11:
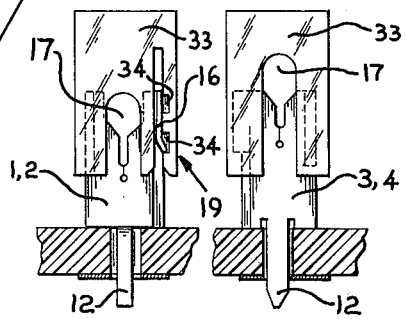
FIGS. 11 and 12 show views of box connectors of the present invention with plastic housings mounted thereon.
Figure 12:
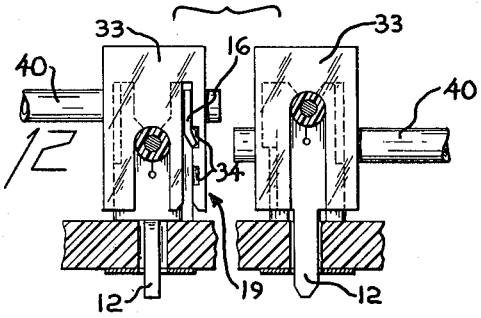

FIGS. 11 and 12 show different side views of the box connector of the present invention having the plastic housings 33 located over it. FIG. 11 shows the preloaded position while FIG. 12 the end position of the plastic housing. In the preloaded position according to FIG. 11, connection wires can be easily introduced through the slots or openings 17 formed by the transverse grooves in the box connector. In the preloaded position, the strip 16 is located in the lowest or first recess 34 in strip 19 of housing 33. After introducing the necessary number of conductors, these conductors will be pressed between the slots of the insulation piercing contacts. This is achieved by depressing the housing 33 further until the end position of FIG. 12 is obtained. While this plastic housing is being depressed the desired electrical connection between the cores of the conductors 40 and the box connector of the present invention has been established. In this end position of the plastic housings, the strips 16 are engaged in the second or uppermost recess 34, as shown on the left-hand side of FIG. 12.

FIGS. 13*a* through 13*d* show various embodiments of a connection strip 12 or the tail end of the box connector of the present invention. Methods are demonstrated whereby tails are connected in the holes of the printed circuit board. The solder operation may be omitted when through-metallized holes in the printed circuit board are used. Such holes are internally cladded with a continuous electrically conducting connection layer 43. The sharp edges of the strips 12 dig easily into the internal cladding 43 of these holes when such strips are pushed into the holes. An excellent and continuous electrical connection with the printed circuit on the board is achieved in this manner.

Figure 13A:
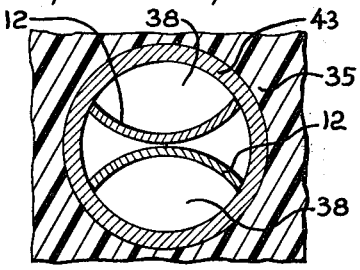
FIGS. 13*a–d* show embodiments of connection strips or tails.

The embodiment of FIG. 13*a* shows the cross section of a strip located about halfway through the hole 38. These connection strips 12 are initially bent such that their convex sides face each other and their concave sides are directed outward towards the hole wall. The outer edges of the strips 12 establish the electrical connection with the internal cladding layer 43.

Figure 13B:
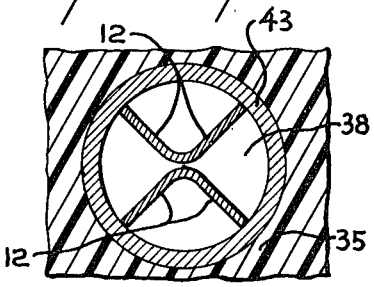
Figure 13C:
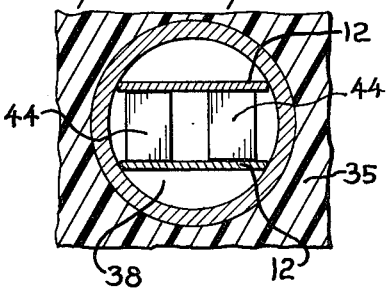

FIG. 13*b* shows an embodiment having connection strips 12 bent in a V-shape. The apex of these strips face each other.

In the two above embodiments, the two strips 12 also can be bent in their longitudinal direction such that they elastically curve away from each other when not inserted in the hole 38.

Figure 13D:
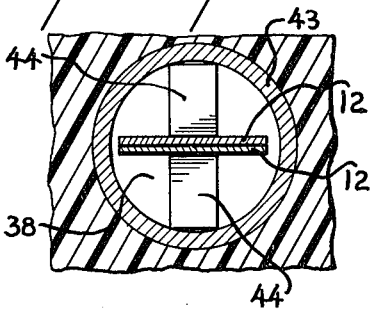

The connection strips can also be provided with small resilient bent side strips similar to the strip 16 at the side wall of the box connector. These strips 44 as evident in FIG. 13*c*, can be bent inward, that is in the direction towards the adjacent strip 12. These connection strips 12 then are pressed away from each other due to spring action. Hence the strip edges come into contact with the internal cladding 43 during introduction of the tail into the hole 38 to establish the electrical connection. Simultaneously, these connection strips 12 can also be provided with strips 44 which are bent outwardly as shown in FIG. 13*d*, whereby the strips 44 establish the contact with the cladding 43. For the connector tail variant shown in FIG. 13*d*, strips 44 should be bent outward towards the free ends of the connection strips 12 in such a manner that it is directed upward towards the box connector itself. This facilitates the insertion of the tail in the holes 38.

As a matter of course, the present invention is not limited to the embodiments of the connection strips 12 as shown and discussed here.

The slots of the insulation piercing contacts also can be of different width, so that connection wires having different cross sections of the cores and in total diameter, can be terminated.

The above-described invention, as shown on the drawings, provides a solderable box connector providing a means by which connection wires can be rapidly and easily terminated. Particularly the invention facilitates easy removal of connection wires for repair purposes. Subsequently new connection wires can be terminated in these connectors. Box connectors can be delivered with or without plastic housing 33 as an option. Generally, the customer obtains plastic housing 33 mounted in preloaded condition on the box connector. As such these plastic houses cannot be misplaced and the box connector and housing are united and ready for the termination of the connection wires. This facilitates connector assembly.

As a matter of course the present invention is not limited to the shown embodiments, so that variations are possible without departing from the scope of the present invention.

I claim:

1. A box connector having insulation piercing contacts, characterized by a four side wall box made of electrically conductive sheet material, two corresponding pairs of slots in opposite side walls containing insulation piercing contacts said slots extending from the top of the box over a predetermined length towards the bottom of said box, each pair of slots terminating in a same level but at a different level with respect to the other pair of slots, a pair of connecting strips formed adjacent the bottom edge of said box in opposite side walls, each said strip initially converging and subsequently extending downwardly and adjacent to each other to form a means for mounting in a printed circuit board hole.

2. Box connector according to claim 1, characterized in that said connecting strips arranged adjacent the bottom edge of two opposite side walls are bent by a first angle so that they approach each other via a neck section and, when closed, are bent again by a second angle, then extending downwardly and adjacent each other, the bent portion of the first angle being located above the bottom edge of said box and notches being provided between the bent portion of said first angle and each nearest side wall in such a way that the bottom of the box in assembly forms a contact edge with a printed circuit board.

3. A box connector according to claim 1, characterized in that said slots are widened at the upper edge of said box, and narrower towards the bottom of said slot, the lowest portion of said slot being semi-circular and a circular hole provided in the sheet material at a predetermined distance vertically below the bottom of said slot and a continuing cut in the sheet material between the bottom said slot and the upper edge of said hole.

4. Box connector according to claim 1, characterized by a box-shaped plastic housing enclosing at least part of said box connector, said housing having an open bottom with slots in the vertical side walls of said housing, said slots extending from the lower edge of said housing towards the upper edge and coincide, after the housing has been placed on the box connector, with the slots of said connector.

5. A box connector according to claim 4, characterized in that said housing has double side walls with a groove in between each wall for receiving the vertical side walls of the box connector.

6. Box connector according to claim 4 or 5, characterized in that, in at least one vertical side wall of the box connector, a strip is formed for locking to said plastic housing placed said box connector, said strip consisting of an outwardly bent strip-shaped sheet portion, recesses being located in an inside wall of said plastic housing for receiving the strip on the side wall of the box connector and for holding the housing in place on the box connector.

* * * * *